United States Patent [19]

Jaster

[11] Patent Number: 4,785,916

[45] Date of Patent: Nov. 22, 1988

[54] CALL REGISTRATION AND ACKNOWLEDGEMENT SYSTEM FOR AN ELEVATOR AND METHOD OF TESTING SUCH SYSTEM

[75] Inventor: John E. Jaster, Rock Island, Ill.

[73] Assignee: Montgomery Elevator, Moline, Ill.

[21] Appl. No.: 860,887

[22] Filed: May 8, 1986

Related U.S. Application Data

[63] Continuation of Ser. No. 567,560, Jan. 3, 1984, abandoned.

[51] Int. Cl.[4] ..... B66B 1/00

[52] U.S. Cl. ..... 187/121

[58] Field of Search ..... 340/19 R, 20, 21; 187/29 R, 121

[56] References Cited

U.S. PATENT DOCUMENTS

| | | | |
|---|---|---|---|
| 4,120,381 | 10/1978 | Otto et al. | 187/29 R |
| 4,230,206 | 10/1980 | Brooks | 187/29 R |
| 4,246,983 | 1/1981 | Bril | 187/29 R |
| 4,330,838 | 5/1982 | Yomeda et al. | 364/580 |
| 4,458,187 | 7/1984 | Heiman | 318/490 |

*Primary Examiner*—Joseph A. Orsino
*Assistant Examiner*—Jeffery A. Hofsass
*Attorney, Agent, or Firm*—Wood, Dalton, Phillips, Mason & Rowe

[57] ABSTRACT

An elevator system for controlling an elevator car includes an elevator control having an input/output port and means for latching the port at a voltage level when a signal is coupled thereto. A single wire connects the elevator control to each of a plurality of call registration means which are disposed remotely from the elevator control, with the call registration means actuable to request elevator service. Each single wire also connects call acknowledgement means to the elevator control, with the call acknowledgement means actuable by the control to acknowledge a request for elevator service. Actuation of the call registartion means causes a signal to be coupled over the single wire to the input/output port, in turn causing the port to be latched at the voltage level. This voltage is connected by the single wire to the acknowledgement means to actuate same and thereby acknowledge a request for elevator service.

8 Claims, 3 Drawing Sheets

FIG. 1 PRIOR ART
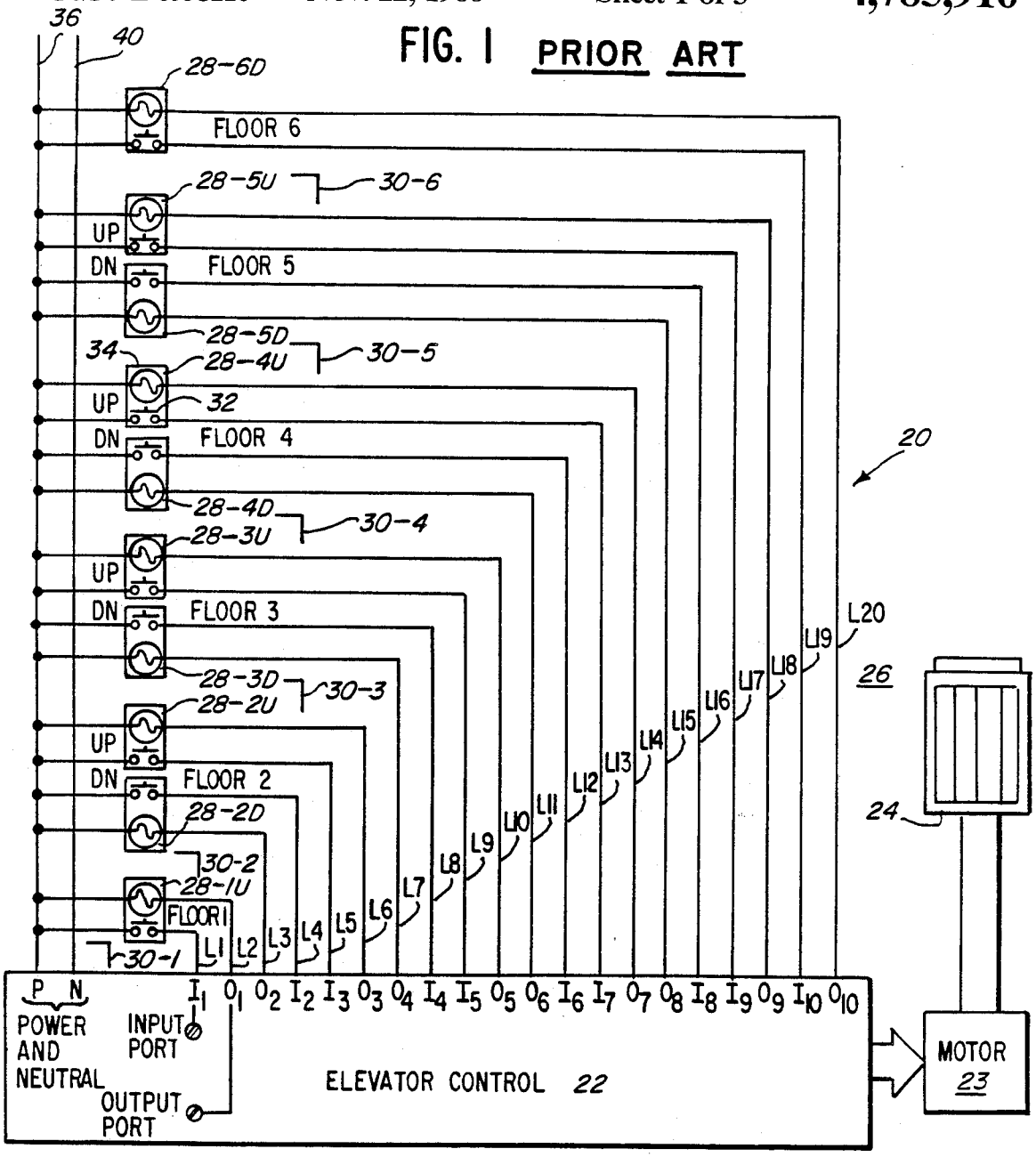
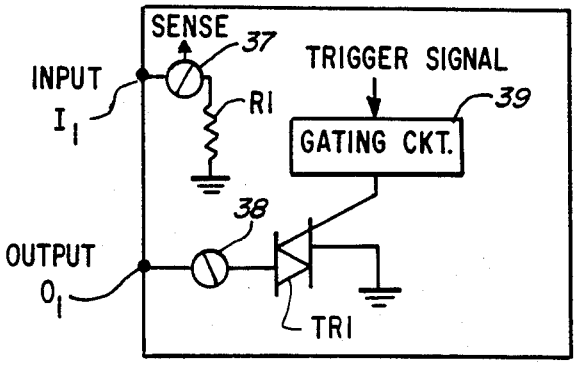
FIG. 2
PRIOR ART

FIG. 3
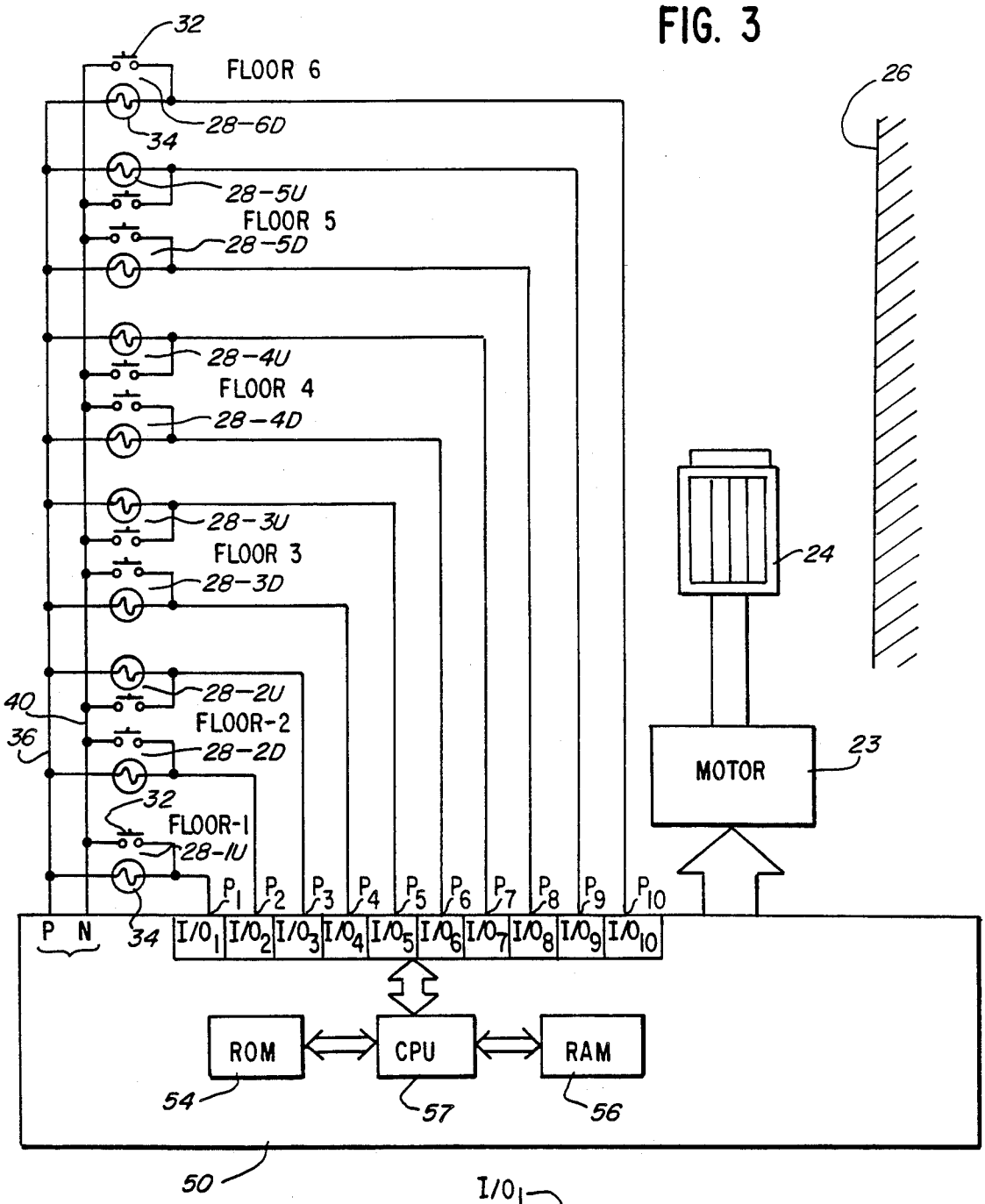
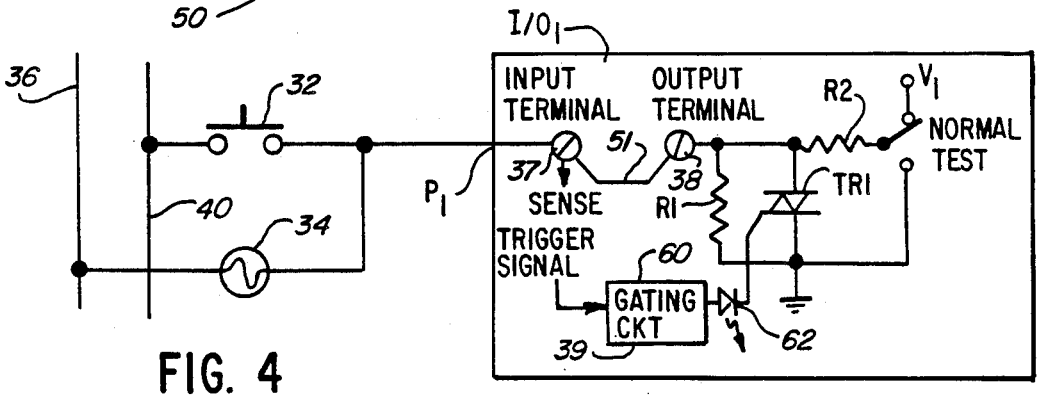
FIG. 4

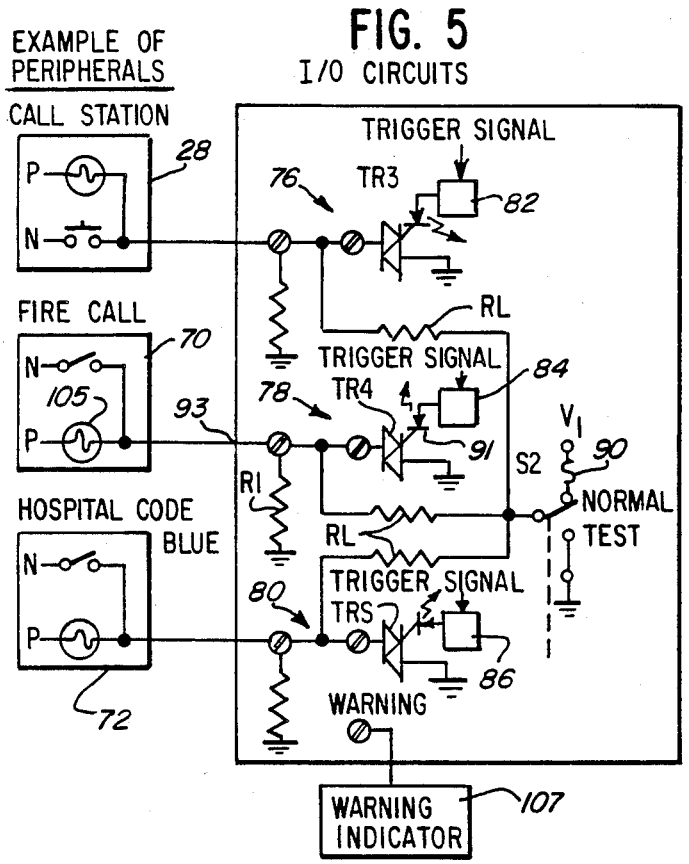
FIG. 5
I/O CIRCUITS
EXAMPLE OF PERIPHERALS
CALL STATION
FIRE CALL
HOSPITAL CODE BLUE
TRIGGER SIGNAL
TR3
TR4
TRS
RL
RI
S2
NORMAL
TEST
WARNING
WARNING INDICATOR
28
70
72
76
78
80
82
84
86
90
91
93
105
107

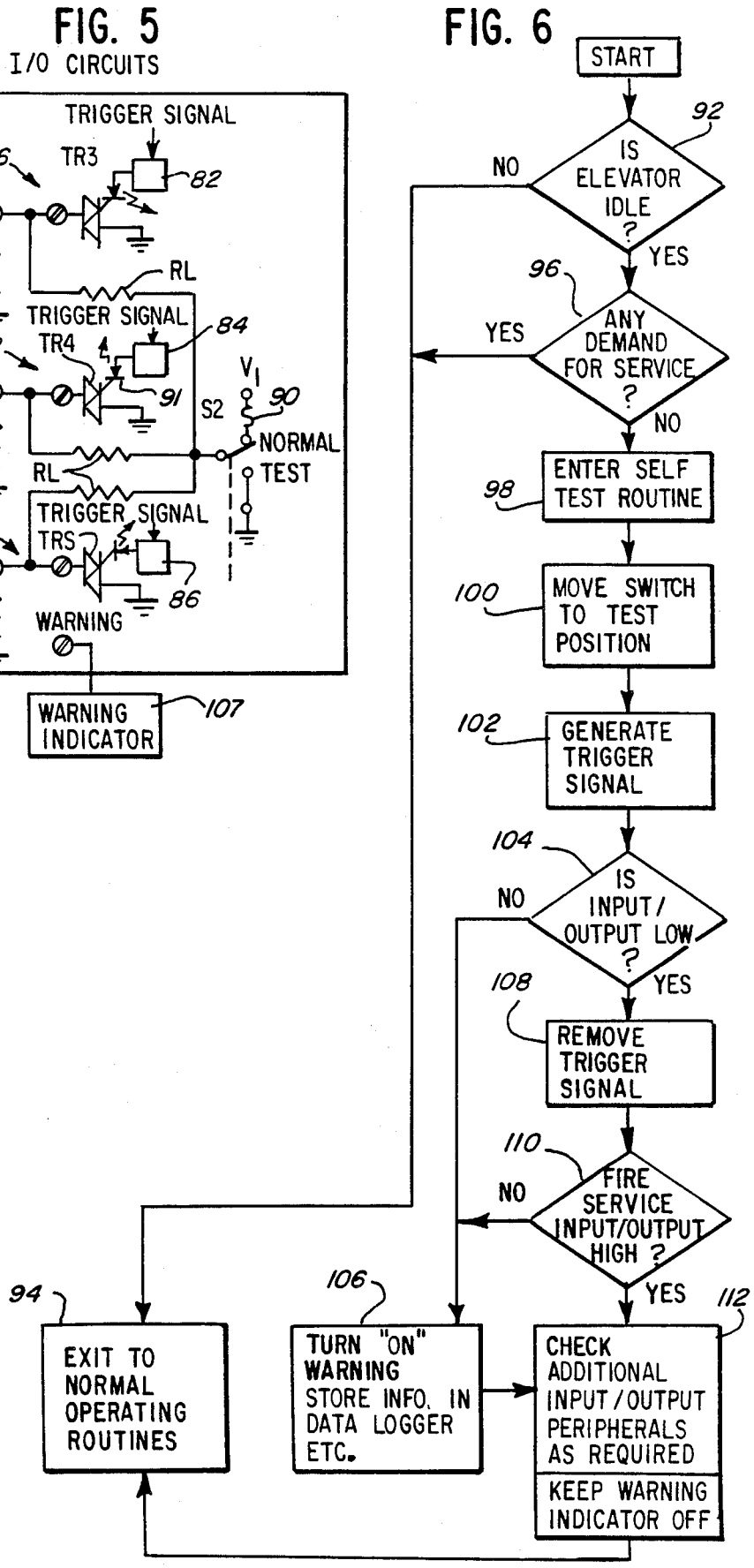
FIG. 6
START
IS ELEVATOR IDLE ?
NO
YES
ANY DEMAND FOR SERVICE ?
YES
NO
ENTER SELF TEST ROUTINE
MOVE SWITCH TO TEST POSITION
GENERATE TRIGGER SIGNAL
IS INPUT/OUTPUT LOW ?
NO
YES
REMOVE TRIGGER SIGNAL
FIRE SERVICE INPUT/OUTPUT HIGH ?
NO
YES
EXIT TO NORMAL OPERATING ROUTINES
TURN "ON" WARNING STORE INFO. IN DATA LOGGER ETC.
CHECK ADDITIONAL INPUT/OUTPUT PERIPHERALS AS REQUIRED
KEEP WARNING INDICATOR OFF
92
94
96
98
100
102
104
106
108
110
112

CALL REGISTRATION AND ACKNOWLEDGEMENT SYSTEM FOR AN ELEVATOR AND METHOD OF TESTING SUCH SYSTEM

This is a continuation of application Ser. No. 567,560 filed Jan. 3, 1984 now abandoned.

DESCRIPTION

Background of the Invention

The present invention relates generally to elevator systems, and more particularly to a call registration and acknowledgement system.

One prior elevator control system is disclosed in Bril U.S. Pat. No. 4,246,983, assigned to the assignee of the instant application. This elevator control includes a microcomputer controller having a plurality of input ports and output ports connected to call stations. The input ports are coupled to call registration buttons of the call stations at which elevator service is requested. Each output port is connected to a light located adjacent the call registration button which is energized whenever the adjacent button is depressed.

The elevator control system disclosed in the above-noted Bril patent requires two hoistway wires to connect each call station to the elevator control. Also, a power wire, a neutral wire and a ground wire must be disposed in the hoistway to allow signalling and to provide power for the acknowledgement lights.

While the above-noted system disclosed in the Bril patent is useful to control one or more elevator cars, it is desirable to reduce the wiring required for a given installation.

Moreover, it is desirable to incorporate self-test functions in the elevator control to determine the operability thereof as well as the operability of various peripheral devices.

SUMMARY OF THE INVENTION

In accordance with the present invention, an elevator system includes a control having combined input/output ports which result in a substantial reduction in the number of hoistway wires required to connect remote call stations to the elevator control.

The elevator system includes a plurality of call stations disposed at points in a building serviced by one or more elevator cars. Each call station includes call registration means actuable to register a request for elevator service and acknowledgement means actuable to acknowledge a service request. An elevator control is disposed remotely from the call stations and includes a plurality of input/output ports and means actuable by a signal to latch each input/output port at a voltage level. A single wire connects the call registration means and the acknowledgement means of each call station to an input/output port of the elevator control so that when a request for elevator service is registered, the input/output port is latched at the voltage level to actuate the acknowledging means.

The elevator system according to the present invention requires half as many hoistway wires connecting remote call stations to the elevator control as compared with prior elevator controls, exclusive of hoistway power lines.

Moreover, by combining the input and output ports on the elevator control, the control can incorporate self-test functions which check the operability of the control and various peripheral components. This is accomplished in part by generating a signal to attempt to latch the input/output port at the voltage level and checking the status of the port to determine whether such latching was successfully accomplished. If this is not the case, then a failure has occurred in the means for latching the port, or there is a break in a hoistway wire to the call station or the acknowledgement means is inoperative. This self-test function can be accomplished either by manual intervention, such as by an elevator serviceman or may be incorporated as part of the overall function of the elevator control system.

BRIEF DESCRIPTION OF THE DRAWINGS

FIG. 1 is a combined schematic and block diagram illustrating a prior art elevator control system;

FIG. 2 is a partial schematic diagram of input and output circuits incorporated in the elevator control shown in FIG. 1;

FIG. 3 is a combined schematic and block diagram of an elevator control system incorporating an elevator control according to the present invention;

FIG. 4 is a partial schematic diagram of an input/output port and an input/output circuit incorporated in the elevator control shown in FIG. 3;

FIG. 5 is a combined schematic diagram of several input/output circuits and several call stations; and FIG. 6 is a flow diagram of programming contained in the elevator control shown in FIG. 3 which, in conjunction with the circuitry shown in FIG. 5, accomplishes the self-test function.

DESCRIPTION OF THE PREFERRED EMBODIMENT

Referring now to FIG. 1, there is illustrated a prior art elevator control system 20. The system 20 includes an elevator control 22 which controls a prime mover such as a motor 23 to in turn control the position of an elevator car 24 in a hoistway 26. The elevator control 22 receives requests for elevator service from a plurality of remote call stations 28 disposed on each floor 30 of a building.

In the illustrated embodiment, the building includes six floors 30-1 through 30-6. The elevator control system 20 may service a different number of floors and/or may control additional elevator cars, as desired.

Disposed on each floor is at least one call station 28 with intermediate floors between the lowest and highest floors having two call stations, one actuable to request and acknowledge a request for elevator service in the up direction and the other actuable to request and acknoweldge a request for elevator service in the down direction. The lowest floor 30-1 has only one call station 28-1U at which a request for elevator service in the up direction can be registered while the topmost or highest floor 30-6 has a single call station 28-6D at which a request for elevator service in the down direction may be registered.

The elevator control 22 also operates the elevator car 24 in accordance with commands from an occupant of the car 24 registered at a call station which is part of a control panel (not shown).

The prior art elevator system shown in FIG. 1 requires a separate hoistway wire to connect the control 22 to call registering means 32 and to connect the control to call acknowledgement means 34, both disposed within each call station 28. That is, in the case of the up call station on the first floor 28-1U, the call registering means in the form of a normally open push button switch requires its own hoistway wire to connect same to the control 22 as does the associated acknowledging means 34 is in the form of a light bulb.

For example, if a potential user wishes to request elevator service in the up direction on the first floor, the push button 32 is depressed, thereby coupling a high state request signal from a power line 36 to the control 22 over a line $L_1$ to an input $I_1$. If the control 22 determines that the service request is to be acknowledged, an output $O_1$ is caused to assume a low state, such as ground. Hence, on side of the light bulb 34 is connected to ground while the other side is connected to the power line 36 and hence the light bulb 34 is lit, thereby acknowledging the service request.

As seen in FIG. 2, a typical input circuit, such as $I_1$, includes an input terminal 37 and a 10 kilohm resistor R1 connected between the terminal 37 and ground. A typical output, such as $O_1$, includes an output terminal 38 and is latched by the control 22 in response to a service request. The control 22 generates a trigger signal which is coupled to a gating circuit 39 to render conductive a triac TR1 and thereby connect the output terminal 38 to ground potential.

Referring again to FIG. 1, for the illustrated embodiment in which 10 call stations are used to request elevator service, a total of twenty hoistway wires are required to register and acknowledge service calls. This number is in addition to the power line 36, a ground line (not shown) which is connected to a box containing each call station 28 and a neutral line 40.

Referring now to FIG. 3, the number of hoistway wires for connecting remote call stations to the elevator control is substantially reduced by the present invention. In FIGS. 1 and 3, like structures have identical reference numerals.

As seen in FIG. 3, one terminal of each push button switch 32 is connected to a terminal of an associated light bulb 34 and to one of a plurality of input/output ports $P_1$14 $P_{10}$ of an elevator control 50. The remaining side or terminal of each light bulb 34 is connected to the power line 36 while the remaining terminal of each push button 32 is connected to the neutral line 40.

In the preferred embodiment, the elevator control 50 may take the form shown in Bril U.S. Pat. No. 4,246,983, assigned to the assignee of the instant application and the disclosure of which is hereby incorporated by reference. The description of the elevator control 24 in the instant specification is limited to those portions pertinent to an understanding of the present invention, it being understood that a more detailed description may be had by reference to the above-identified patent.

Referring also to FIG. 4, the input/output ports $P_1$–$P_{10}$ of the control 50 are connected to an input/output circuit $I/O_1$–$I/O_{10}$, respectively.

The elevator control 50 may be essentially identical to that shown in FIG. 1 with modifications effected to incorporate the present invention. In the preferred embodiment, the elevator control 50 is a microcomputer having internal memory such as a read only memory, or ROM 54, a random access memory, or RAM 56 and a central processing unit, or CPU 57. The ROM 54 incorporates the control program and the constants used during the course of a program execution. The RAM 56 contains registers which store various flags, intermediate and final results over the course of a program cycle.

As seen in FIG. 4, the elevator control 22 shown in FIG. 1 is modified by connecting a jumper 51 between each input terminal 37 and the associated output terminal 38 and by adding circuit elements, as noted more specifically below.

The resistor R1 and triac TR1 are connected in parallel between the output terminal 38 and ground potential. A load resistor R2 is connected between the output terminal and the wiper of a switch S1. The wiper of the switch S1 is movable so that the resistor R2 can be connected either to the power line 36 having a voltage $V_1$ or to ground potential. The switch S1 is shown in FIG. 4 in a normal position wherein the input and output terminals are connected through the resistor R2 to the power line 36. As will be described in later portions of the specification, a self-test procedure can be initiated by moving the switch S1 to the other position to connect the resistor R2 to ground potential.

In the event elevator service is desired on a particular floor, e.g. the first floor, a user depresses the push button 32, thereby closing the contacts to establish a voltage potential across the light bulb 34 and to cause the input/output port $P_1$ to drop to ground potential. This low potential signal is sensed by the CPU 57 and the control program executed by the CPU then makes a logical determination whether to acknowledge the request for service. If this request is to be acknowledged, the CPU generates a trigger signal, FIG. 4, which is coupled to a gating circuit 60 to fire the triac TR1. Additionally, a light-emitting diode or LED 62 is caused to illuminate due to the gating of the triac TR1.

When the triac TR1 fires, the input and output terminals 37,38 are connected through the triac to ground potential and are latched at low voltage. The gating circuit 60 and the triac TR1 therefore comprise latching means for the input/output ports.

Since the input/output port is latched to a low voltage level, the voltage difference is maintained across the bulb 34 and hence the bulb remains lit. The latch on the input/output port is removed by the control program of the elevator control once the elevator has reached the floor at which the request for service was made.

As can be noted by a comparison of FIG. 3 with FIG. 1, the elevator control according to the present invention requires only half as many hoistway wires to connect the elevator control to the call stations, thereby resulting in a substantial savings in wiring.

Referring now to FIG. 5, the elevator control of the present invention may incorporate a self-test feature which allows the elevator control to test the operability of the elevator control and various peripheral components. As seen in FIG. 5, the peripheral equipment may include one or more call stations 28, a fire call station 70 and a hospital code blue call station 72. Each of the call stations 28,70,72 is connected to an input/output circuit 76,78,80, respectively, each identical to the input/output circuit $I/O_1$ shown in FIG. 4. Each circuit includes a triac TR3–TR5, respectively, individually energizable by trigger signals and gating circuits 82,84,86 to connect the respective input/output to ground. Each input/output is also connected through load resistors $R_L$ to a movable wiper of a switch S2. The wiper of the switch S2 is either manually movable or actuated under programming control to connect the load resistors $R_L$ to the voltage $V_1$ through a fuse 90 ("normal position") or to connect the load resistors $R_L$ to ground (hereinafter denoted the "test position").

Referring now specifically to FIG. 6, there is illustrated programming contained within the ROM 54 shown in FIG. 3 to incorporate the self-test function. This programming is an addition to the programming for the elevator control functions.

Control begins at a block 92 which senses the current status of elevator operation to determine whether the elevator is idle. If this is not the case, then control passes to the normal operating routine for the elevator control, block 94. On the other hand, if the elevator is idle and if a block 96 determines that there is no demand for service, then control passes to a block 98 which begins the self-test mode of routine. Conversely, if a service call has been requested, then control from the block 96 passes to the block 94 to service the request.

A block 100 moves the switch S2 to the test position. As previously noted, this step may be accomplished manually, if desired.

Following the block 100, a block 102 generates a trigger signal for one of the triacs, for example TR4. The trigger signal is coupled through the gating circuit 84 to the gate electrode of the triac TR4 through an LED 91. If the elevator control programming, gating circuit 84 and triac TR4 are all operative, then the input/output voltage at the input/output port 93 should drop to a low value close to ground potential.

A block 104 then determines whether the input/output is low. If not, control passes to a block 106 which turns on a warning indicator 107 to alert a serviceman or operator as to the existence of a malfunction. The block 106 may also store information regarding the fault in a data logger or may actuate other warning or logging devices, as desired.

The input-output port may be sensed as being in the high state (indicating a fault) due to failure of one or more of the components such as the triac TR4, the LED 91 in the gas circuit of the triac, the resistor R1, a failure in connections, a failure in trigger signal generation, or a fault in the voltage sensing at the I/O port 93.

If the block 104 determines that the input/output is low, indicating that the elevator control and the fire call station are both operative, then control passes to a block 108 which removes the trigger signal from the gating circuit 84. If the triac TR4 is fully operative, i.e. if it has not faulted in a shorted condition, then the triac TR4 should turn off and allow the input/output to assume a high state. A block 110 checks to determine whether the fire service input/output is high, and if this is not the case, then control passes to the block 106 to energize the warning indicator. The input/output port may be sensed as being in the low state due to a failed triac, a failed lamp, a break in the hoistway wire connecting the call station to the port or any of the failure in components noted above.

On the other hand, if the fire service input/output is high, indicating that the elevator control and the fire call station are completely operative, control passes to a block 112 which checks the remaining input/output peripherals, as required. During this time, the block 112 maintains the warning indicator in an off position.

Following the block 112 control passes to the block 94 to continue the normal elevator operating routines.

It should be noted that once a failure or fault has been detected with the switch in the test position, the switch can be returned to the normal position to determine whether the failure is in the input/output circuit or in the peripheral device and/or wiring. After the switch S2 is moved to the normal position, the blocks 102–112 shown in FIG. 6 rerun the tests for the peripheral devices for which a fault indication was generated. If all tests are now passed, the fault is in the peripheral device (specifically, a failed bulb) or the hoistway wire connecting the peripheral device to the input/output port is faulty. On the other hand, if the tests do not all pass, then the fault in in one or more of the I/O circuit components.

As previously noted, the switch S2 can be moved manually to the test position to determine whether any of the peripheral device bulbs are faulty. For example, if the switch S2 is moved to the test position, then the input/output port 93 is connected through the load resistor $R_L$ to ground. If the bulb 105 is faulty, the input/output port 93 assumes a low state, and the elevator control interprets this low state signal as a request for elevator service and responds by generating a trigger signal. This in turn causes the LED 91 to light and thereby indicate that the bulb 105 has failed. The LED 91, as well as other LED's in the triac gate circuits are conveniently disposed in the elevator control room so that a serviceman can check the operability of all peripheral device bulbs without physically inspecting each peripheral device.

It should be noted that the system of the present invention may be utilized to connect the call station in the elevator car to the elevator control and thereby reduce the number of traveling wires in the hoistway.

I claim:

1. In an elevator system having an elevator control for controlling an elevator car in a hoistway, a call registration and acknowledgement system, comprising:

call registration means remote from the elevator control for transmitting a request signal to request elevator service;

the elevator control inluding an input/output port and means for latching the port at a voltage level when a signal is coupled thereto, the latching means including a triac connected between the input/output port and ground potential having a gate electrode and means coupled to the gate electrode for generating a gating signal, the elevator control further including a resistor connected to the input/output port, a switch for selectively coupling the resistor to either first or second voltage levels, and means coupled to the switch and to the triac for operating the elevator control in a test mode to determine the operability of the elevator control and the call acknowledgement means;

a single wire connecting the call registration means to the input/output port so that the port is latched at the voltage level when a request signal is developed; and call acknowledgement means remote from the elevator control connected to the single wire and actuable in response to the latching of the port to acknowledge a request for elevator service.

2. The system of claim 1, wherein the acknowledgement means is connected between the second voltage level and the single wire and wherein the test mode operating means includes means for controlling the switch to connect the resistor to the first voltage level, means coupled to the gating means for controlling same to cause a gating signal to be generated after the resistor has been connected to the first voltage level and means for checking the voltage at the input/output port when the gating signal is generated.

3. The system of claim 1, wherein the test mode operating means further includes a light-emitting diode connected in series between the gating means and the gate electrode of the triac which is energized when the gating signal causes the triac to conduct.

4. In an elevator system including an elevator control having a combined input/output port, call acknowledgement means connected between a first voltage and the input/output port, the input/output port being connected through a load resistor to a switch for selectively connecting the load resistor to the first voltage or to a second voltage, a triac connected between the input/output port and the second voltage having a gate electrode and means coupled to the gate for generating a gating signal to gate the triac, a method of testing the operability of certain components of the elevator system, comprising:

(a) operating the switch to connect the load resistor to the second voltage;

(b) operating the generating means to develop the gating signal; and (c) sensing the voltage at the input/output port to determine whether such voltage is close to the second voltage thereby indicating that the triac and generating means are operative.

5. The method of claim 4, including the further steps of: (d) removing the gate signal from the gate electrode; and (e) detecting the voltage at the input/output port to determine whether such voltage is at a level indicative of the operability of the triac and the call acknowledgement means.

6. The method of claim 4, wherein the elevator control system includes a plurality of call acknowledgement means connected to a plurality of input/output ports and including the further step of repeating steps (a)–(c) for each of the input/output ports and call acknowledgement means.

7. The method of claim 4, wherein the elevator control system includes a warning indicator and including the further step of energizing the warning indicator when the voltage at the input/output is not close to the second voltage while the gate signal is developed.

8. The method of claim 4, including the further step of storing an indication of a failure when the triac is found to be inoperative.

* * * * *